US005730302A

United States Patent [19]

Groene

[11] Patent Number: 5,730,302

[45] Date of Patent: Mar. 24, 1998

[54] RAZOR RACK AND METHOD

[76] Inventor: Christopher Dean Groene, 33201 11th Ave. SW., Federal Way, Wash. 98023

[21] Appl. No.: 647,119

[22] Filed: May 9, 1996

[51] Int. Cl.[6] ..... A47F 7/00

[52] U.S. Cl. ..... 211/70.6; D6/534; 211/60.1

[58] Field of Search ..... 211/70.6, 60.1; D6/534, 526; 248/205.5

[56] References Cited

U.S. PATENT DOCUMENTS

| | | | |
|---|---|---|---|
| D. 162,978 | 4/1951 | Neumann | D6/534 |
| D. 193,764 | 10/1962 | Gygie | D6/534 |
| D. 201,788 | 8/1965 | Robertson | D6/534 |
| 1,050,864 | 1/1913 | Smith | D6/534 X |
| 1,228,261 | 5/1917 | Taylor | D6/534 X |
| 1,409,701 | 3/1922 | Giles | D6/534 X |
| 1,474,891 | 11/1923 | Burt et al. | 211/60.1 X |
| 1,506,257 | 8/1924 | Schmidt | 132/310 X |
| 1,636,608 | 7/1927 | Kenyon et al. | 211/60.1 |
| 1,804,962 | 5/1931 | Thorpe | 211/70 |
| 2,099,906 | 11/1937 | Reese et al. | 211/60.1 X |
| 2,758,723 | 8/1956 | Morris et al. | 211/60.1 X |
| 3,104,778 | 9/1963 | Leonard | 211/60.1 X |
| 3,155,238 | 11/1964 | Bennett | 211/70.5 |
| 3,486,630 | 12/1969 | Ellman | 211/13 |
| 4,231,501 | 11/1980 | Goode | 211/70.5 X |
| 4,415,092 | 11/1983 | Boyer | 211/60.1 X |
| 4,644,645 | 2/1987 | Audet | 30/41 |
| 4,773,158 | 9/1988 | Kertzman | 30/90 |
| 5,228,580 | 7/1993 | Grange | 211/70.6 |
| 5,358,127 | 10/1994 | Ennis | 211/60.1 |
| 5,544,764 | 8/1996 | Cima | 211/60.1 |

*Primary Examiner*—Ramon O. Ramirez
*Attorney, Agent, or Firm*—Dean A. Craine

[57] ABSTRACT

A rack for holding a disposable razor in a vertical orientation in a convenient location near the bathroom sink, mirror, or shower stall. The rack includes an elongated frame structure made up of a plurality of interconnected, vertically aligned tubular members. Each tubular member has top and bottom openings and a longitudinally aligned passageway through which the handle of the disposable razor may be inserted. Each tubular member also has a rear opening formed thereon. A suction cup is used to hold the frame structure in an upright vertical position on a support surface. Each suction cup includes a stem portion which may be inserted either into the bottom opening or rear opening of the two end tubular members to hold the rack structure in an upright position. A removable cap is provided which is placed over the last used tubular member. During use, the cap is moved to the next adjacent tubular member after each use so that the razor after use is disposed in the next available tubular member. Optional numbers may be printed on the front surface of the tubular members to visually indicate the number of shaves the razor disposed therein has been used. A method for storing a razor is also disclosed.

6 Claims, 2 Drawing Sheets

RAZOR RACK AND METHOD

BACKGROUND OF THE INVENTION

1. Field of the Invention

This invention relates to racks or stands for holding a disposable razor.

2. Description of the Related Art

Safety blade, replaceable cartridge head, and disposable type razors are designed to provide between three to seven shaves before the blade, cartridge head, or razor, respectively, are thrown away. The actual number of shaves each razor provides depends upon the characteristics of the user's beard, the desired closeness of the shave, and how the type of blades used in the shaver.

When shaving, the edges of the razor's blades become dull due to abrasion caused by the user's skin and beard. During the shaving process, the blades are exposed to water which leads to oxidation and dulls the edges further.

It has been discovered that the manner in which a razor is stored between shaves can impact the number of shaves a razor provides. When a razor is stored vertically or horizontally, excessive rinse water can drip from the razor's head and handle onto the surrounding surface. For example, if the razor is stored so that the blades are in continuous contact with water between shaves, greater oxidation takes place on the blades which substantially reduces their sharpness. A storage rack or stand designed to hold a razor in an upright, vertical orientation between shaves so that rinse water drips away from the blades enabling the blades to dry between shaves is desirable.

A storage rack or stand for holding multiple disposable razors in an upright, vertical orientation between shaves is known in the art (See Ennis, U.S. Pat. No. 5,358,127). One problem with using a disposable razor is that the user is unable to remember or record the number of shaves a particular razor has provided. Without this information, the razors stored on the rack are either under or over used creating excessive expense or discomfort, respectively.

A storage rack or stand for a single razor which also enables the user to accurately determine the number of shaves the razor has provided is also desirable.

SUMMARY OF THE INVENTION

It is object of the invention to provide a rack designed to hold a disposable razor in an upright, vertical orientation so that the razor's blades may completely dry between shaves.

It is another object of the present invention to provide such a rack having means which enables the user to determine the number of shaves the razor has provided.

It is a further object of the present invention to provide such a rack that can be conveniently assembled and used on or near a bathroom sink, mirror or shower stall.

These and other objects are met by providing a rack for holding a razor in an upright, vertical orientation in a convenient location on or near the bathroom sink or mirror or shower stall. The rack includes an elongated frame structure having a plurality of vertically aligned tubular members. Each tubular member has top and bottom openings located at opposite ends, a rear opening formed on a rearward extending receiver rear surface, and a longitudinally aligned passageway formed therein. Each tubular member is interconnected to an adjacent tubular member via a thin web member which can be easily cut to adjust the number of tubular members on the frame structure. The rack also includes two suction cups capable of being selectively attached to a flat support surface. Each suction cup includes a stem portion designed to be selectively inserted into either the bottom opening on the tubular member or the rear opening on the receiver.

Each rack further includes an used indicating means capable of indicating whether the razor has been placed into a particular tubular member. In the embodiment disclosed herein, the used indicating means is a replaceable cap which attaches over the top portion of the tubular member when the razor is removed from the tubular member. When the shave is completed, the user places the razor into the next tubular member located adjacent to the capped tubular member. An optional used reference means is also provided on each tubular member for visually indicating the number shaves provided.

DESCRIPTION OF THE PREFERRED EMBODIMENT(S)

Figure 1:
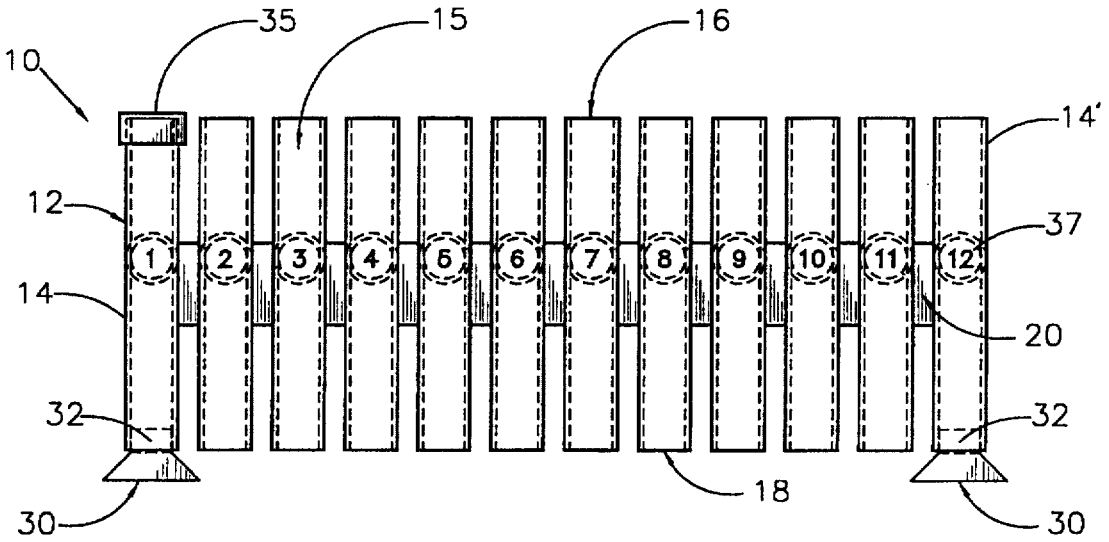
FIG. 1 is a front elevational view of the razor rack disclosed herein.

Shown in the accompanying FIGS. 1–5, there is shown a rack generally referred to as 10, designed for holding a razor 40 with its handle 42 disposed in a vertical orientation in a convenient location near the bathroom sink or mirror. The rack 10 includes a plurality of interconnected tubular members 14 disposed in vertical position which form an elongated frame structure 12. Each tubular member 14 has two opposite top and bottom openings 16, 18, respectively and a longitudinally aligned passageway 15 formed therein. The passageway 15 has a sufficient diameter so that the razor handle 42 may be longitudinally aligned therein. Each tubular 14 is interconnected to an adjacent tubular 14' by a planar web member 20. Formed on the rear surface of each tubular member 14 is a receiver 22. Receiver 22 extends rearward perpendicular to the longitudinal axis of the tubular member and is circular in cross-section with a rear opening 24 formed therein.

Figure 2:
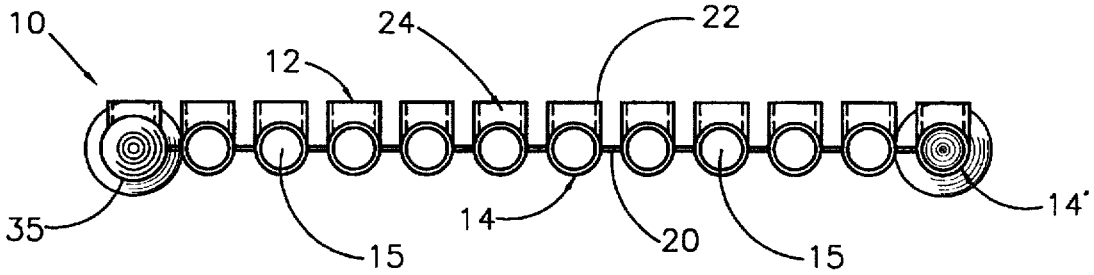
FIG. 2 is a top plan view of the razor rack shown in FIG. 1.
Figure 3:
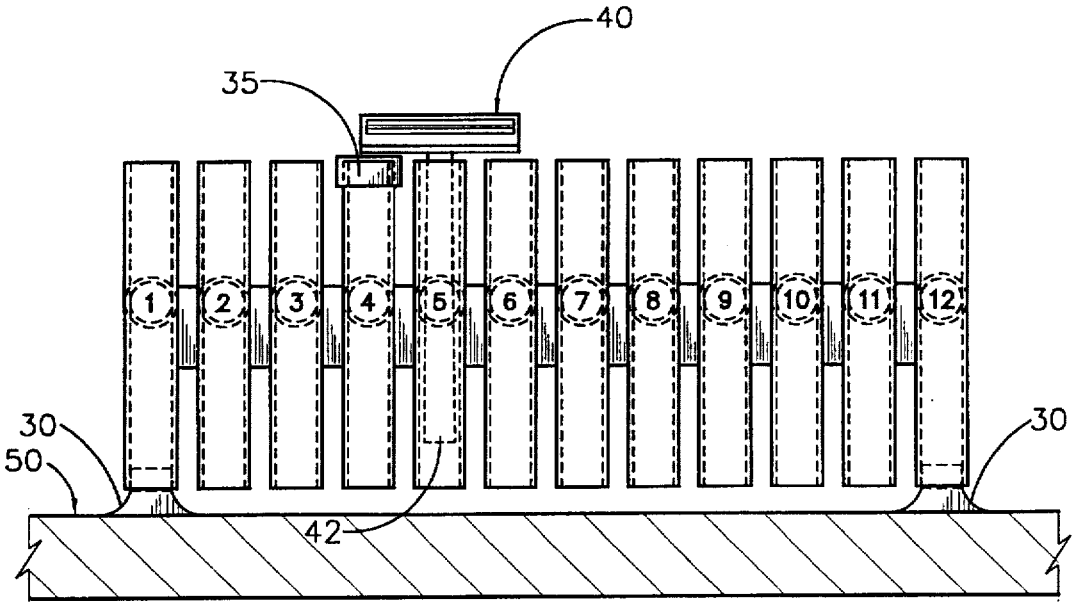
FIG. 3 is a front elevational view of the razor rack similar to FIG. 1 showing the razor rack attached to a horizontally aligned support surface with a razor inserted into the tubular member located adjacent to a capped tubular member.
Figure 4:
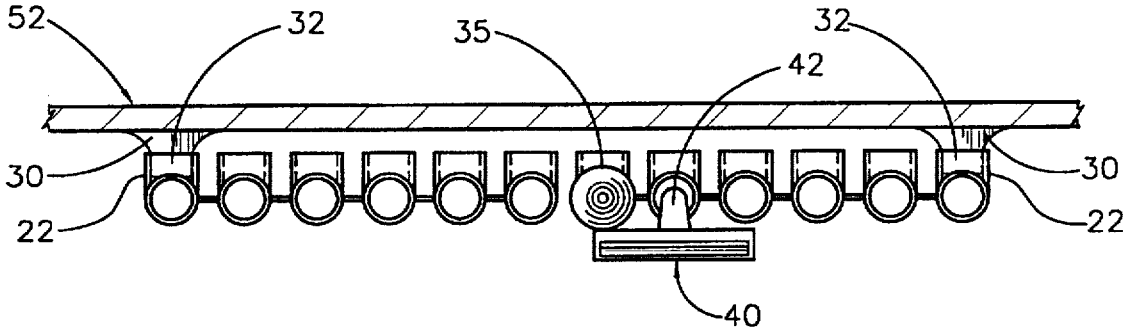
FIG. 4 is a top plan view of the razor rack similar to FIG. 2 showing the razor rack attached to a vertically aligned support surface with a razor inserted into one tubular member and a replaceable cap attached to an adjacent tubular member.

Two suction cups 30 are used to hold the frame structure 12 in a vertical orientation on a horizontal support surface 50 as shown in FIGS. 1–3, such as a bathroom counter top. The two suction cups 30 can also be used to hold the frame structure 12 in a vertical orientation on a vertical support surface 52 as shown in FIG. 4. The vertical support surface 52 may be a mirror or a shower stall. Each suction cups 30 includes a stem portion 32 which can be inserted either into the bottom opening 18 or the rear opening 24 on the tubular member 14. During assembly, one suction cup 30 is attached to the two end tubular members 14 located on opposite ends of the rack.

The rack 10 also includes an used indicating means designed to indicate whether the tubular member 14 has been used to store a razor. In the preferred embodiment, the used indicating means comprises a removable cap 35 which connects over the top opening 16 on the tubular member 14. During use, the removable cap 35 is moved to the right to the next tubular member 14. The user interprets the capped tubular member 14 as the last used tubular member. An optional used reference means, such as numbers 37, are provided on the front surface of each tubular member 14 which visually indicate the number of shaves the razor 40 disposed therein has been used.

Figure 5:
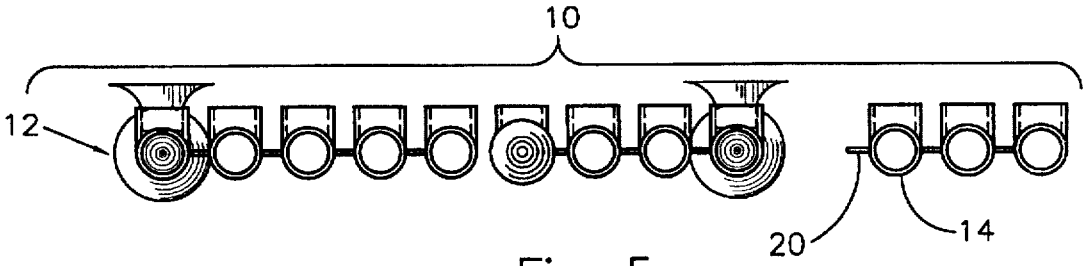
FIG. 5 is a top plan view showing the frame member being adjusted in length by removing tubular members therefrom by cutting the web structure.

As shown more clearly in FIG. 5, the number of tubular members 14 used on the frame structure 12 may be adjusted by cutting the web structure 20 after the last desired tubular member 14. This feature allows the user to adjust the number of tubular members 14 on the frame structure 12 so that a particular disposable razor used with the rack 10 is always thrown away after a predetermined number of shaves.

It should be understood, that the rack 10 may be used with non-disposable razors or other items where it is desirable to store in a horizontal position or indicate the number of uses.

In the preferred embodiment, the components used to manufacture the rack 10 are made of lightweight, molded thermoplastic material.

During use, a convenient location near the bathroom sink or tub or shower stall is first selected for assembling the rack 10. If a vertical surface is used as a support surface, two suction cups 30 are chosen attached to the opposite tubular members 14 by inserting their stem portion 32 into the rear opening 24 on the tubular member 14. If a horizontal surface is used as a support surface, the stem portions 32 are inserted into the bottom openings 18 on the two end tubular members 14. A disposable razor 40 is then selected and disposed in an upright, vertically orientation so that its handle 42 can be inserted into the passageway 15 on the first (or far left) tubular member 14. The removable cap 35 may be either completely removed from the rack 10 or attached to the end (or far right) tubular member 14. After shaving, the removable cap 35 can then moved to the first tubular member (or for left) or attached to the next available tubular member 14.

Once the desired number of shaves for a particular razor is determined, the web member 20 adjacent to the last tubular member 14 is cut to remove the unused tubular members 14 from the rack 10.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A razor rack, comprising:

a. a frame structure including a plurality of interconnected tubular members, each said tubular member having a top opening, a bottom opening, a rear opening, and a longitudinally aligned passageway, said passageway having sufficient diameter to receive and hold the handle of a razor disposed therein;

b. at least one used indicating means capable of being selectively attached to each said tubular member to indicate whether a razor has been immediately removed therefrom, and;

c. at least one suction cup capable of selectively attaching to either said bottom opening or said rear opening on said tubular member and holding said tubular member in a vertical orientation on a desired horizontal or vertical support surface respectively.

2. A razor rack, as recited in claim 1, wherein said used indicating means includes one removable cap capable of being attached over said top opening on said tubular member.

3. A razor rack, as recited in claim 1, further including a web member disposed between adjacent said tubular member, said web member capable of being cut to adjust the number of tubular members on said frame structure.

4. A razor rack, as recited in claim 1, further including a used reference means on each said tubular member to visually indicate the number of said tubular member on said frame structure.

5. A method of storing a razor on a flat support surface including the following steps:

a. selecting a flat support surface;

b. selecting a razor rack capable of holding a razor in an upright, vertical orientation over a support surface, said razor rack including a frame structure having a plurality of vertically aligned, interconnected tubular members, each said tubular member having top, bottom and rear openings and a passageway formed therein, at least one suction cup capable of being attached to said bottom or rear openings to hold said razor rack in an upright, vertical orientation, and an used indicating means capable of being attached to each said tubular member to indicate when said razor has been immediately removed therefrom;

c. attaching said suction cup to at least one said tubular member to hold said frame structure in a vertical orientation on a support surface;

d. inserting said razor into one said tubular member;

e. removing said razor from said tubular member;

f. attaching said used indicating means to said tubular member to indicate that said razor has been immediately removed therefrom;

g. shaving with said razor;

h. inserting said razor into said tubular member located adjacent to the said tubular member with said used indicating means attached thereto; and, i. repeating steps (e) through (h) until said razor is discarded.

6. A method as declared in claim 5, further including step (j) wherein unused said tubular members are removed from said rack.

* * * * *